United States Patent [19]

Mattas et al.

[11] Patent Number: 4,958,107

[45] Date of Patent: Sep. 18, 1990

[54] SWITCHING ARRANGEMENT FOR HID LAMPS

[75] Inventors: Charles B. Mattas, Glenview, Ill.; Egbert Van Zanten, Eindhoven, Netherlands; Stefan P. Szuba, Parkridge, Ill.

[73] Assignee: North America Philips Corporation, New York, N.Y.

[21] Appl. No.: 409,493

[22] Filed: Sep. 19, 1989

Related U.S. Application Data

[63] Continuation-in-part of Ser. No. 334,658, Apr. 6, 1989, abandoned.

[30] Foreign Application Priority Data

Apr. 13, 1988 [NL] Netherlands ..... 8800952

[51] Int. Cl.[5] ..... H05B 41/14; H05B 37/02

[52] U.S. Cl. ..... 315/289; 315/290; 315/244; 315/DIG. 5; 315/DIG. 2

[58] Field of Search ..... 315/289, 290, 244, DIG. 5, 315/DIG. 2

[56] References Cited

U.S. PATENT DOCUMENTS 4,209,730 6/1980 Pasik ..... 315/290
4,337,417 6/1982 Johnson ..... 315/290

FOREIGN PATENT DOCUMENTS 0195248 9/1986 European Pat. Off. .

*Primary Examiner*—Eugene R. LaRoche
*Assistant Examiner*—Ali Neyzari
*Attorney, Agent, or Firm*—Bernard Franzblau

[57] ABSTRACT

Apparatus for starting and operating a high pressure discharge lamp includes a pair of input terms for connection to a high frequency inverter. A step-up transformer couples the input terminals to a pair of output terminals for connection of the discharge lamp. A switching arrangement including a voltage-multiplier circuit, is coupled to the primary winding of the transformer and includes a first branch comprising a first capacitor and a diode and a second branch comprising a diode. Between the first capacitor and the diode of the first branch is connected a third branch comprising a semiconductor switch such as a SIDAC. The first branch is connected through the transformer coil to a first supply source connection point. The second branch is connected to a tap point of the coil. The first and the second branch are connected via a common impedance including second capacitor and an inductor to a second supply source connection point. The third branch is connected directly to both the coil and the diode of the second branch. The SIDAC periodically switches over from a cut-off state to a conductive state in response to a voltage developed across one or more capacitors of the voltage-mulitplier circuit thereby to rapidly discharge the capacitor voltage across the winding of the step-up transformer. A high voltage ingnition pulse is generated in the secondary of the step-up transformer and is applied to the output terminals to ignite a connected discharge lamp.

19 Claims, 2 Drawing Sheets

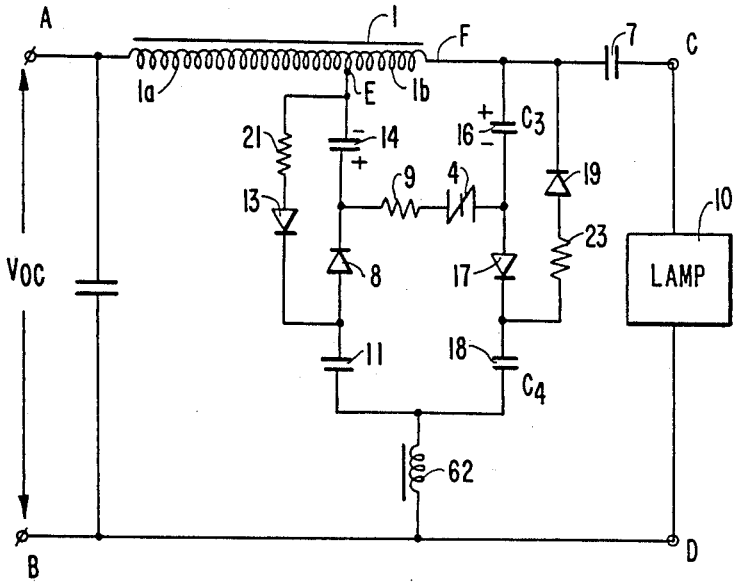
FIG. 2
FIG. 3
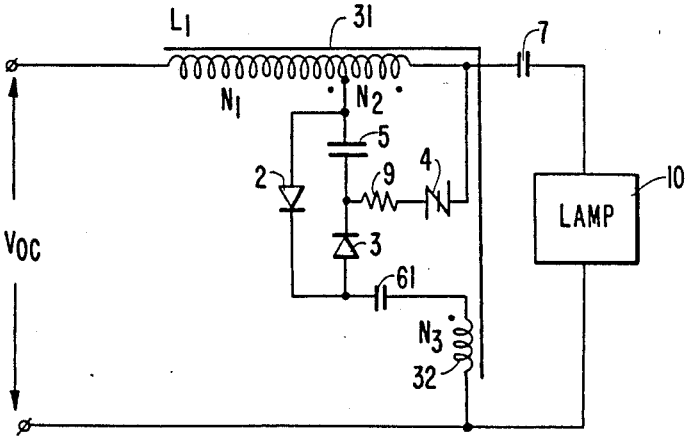

SWITCHING ARRANGEMENT FOR HID LAMPS

This is a continuation-in-part application of U.S. application 334,658, filed Apr. 6, 1989, abandoned.

BACKGROUND OF THE INVENTION

This invention relates to apparatus for starting and operating a high intensity discharge lamp and, more particularly, to a voltage multiplier starting circuit energized by a high frequency AC voltage source and operative to produce high voltage, high frequency ignition pulses for initiating an arc discharge in a HID lamp, in particular a miniature metal halide lamp.

HID lamps, and especially metal halide lamps, have rather stringent requirements as to the starting voltage, the reignition voltage and the lamp current waveform. Prior art ignition circuits for HID lamps are designed for use with a 60 Hz line source. Ignition pulses are delivered at a maximum rate of one for each half cycle or at most a 120 Hz repetition rate. The use of a high frequency source such as an electronic inverter will result in a smaller, lower loss ballast. It also makes it possible to deliver ignition pulses at a higher repetition rate, which gives improved lamp ignition and/or ignition at a lower peak voltage.

As the repetition rate is increased, it is important that the losses in the starting circuit and the loading on the inverter be limited to a safe value so that if lamp ignition does not take place (such as at the end of lamp life), circuit failure will not occur.

One of the first circuits developed to generate high voltage ignition pulses for starting metal vapor or high pressure sodium discharge lamps of the type that require relatively high ignition voltage pulses in order to provide reliable ignition thereof is shown in U.S. Pat. No. 3,917,976 (11/4/75). This prior art circuit operates directly from a 120V, 60 Hz AC supply voltage.

The invention also relates to a switching arrangement for starting a high-pressure discharge lamp provided with a first supply source connection point for connecting a supply source and with at least one lamp connection point for connection to the high-pressure discharge lamp. An electric coil with a tap point is connected between said supply source connection point and said lamp connection point. The switching arrangement further comprises a first and a second branch each including a diode and each connected to the coil. One of the branches is connected to the tap point on the coil. Both diodes are connected to each other by a third branch which includes a semiconductor switch. The third branch is connected at one side directly both to the coil and the diode of the second branch and the first branch includes a first capacitor coupled between the coil and the third branch and the relevant diode. The first and second branches are connected through a common impedance comprising a second capacitor to a second supply source connection point.

This kind of switching arrangement is described in U.S. Pat. No. 4,337,417 (6/19/82). In this known switching arrangement, the common impedance includes a resistor of substantial resistance value. The resistor will influence the rate of charge of the second capacitor and the resistor also insures that the voltage pulse produced in the switching arrangement does not flow away directly to the supply source This requires that the resistor have a high value. The resistor then substantially reduces the voltage pulse repetition frequency due to its high value. This is especially important where the supply source has a high frequency, at least a frequency which is considerably higher than 50 Hz.

The above patent uses a voltage doubler as part of the starting circuit. It is energized directly from the 60 Hz, 120 V AC supply and uses a transformer with a step-up transformation ratio of 20:1. The resistor in the charge path of the capacitors of the voltage doubler limits its use to low pulse repetition rates. High frequency operation with a 10 KHz AC source, even with only 1–2 KHz ignition pulse repetition rates, would result in excessive losses in the resistor or in loading of the pulses by the ignition circuit.

Another circuit which features a voltage doubler starting circuit for sodium vapor street lamps is U.S. Pat. No. 4,209,730 (6/24/80). High voltage ignition pulses are periodically applied to the lamp via the ballast. This circuit also operates directly from the 60 Hz, AC supply voltage.

U.S. Pat. No. 4,143,304 (3/6/79) also utilizes a voltage doubler circuit for starting a high pressure sodium discharge lamp and operates directly from the 60 Hz AC supply line. It uses a charge resistor with the attendant disadvantages of lower efficiency etc. mentioned above The prior art circuits described above are adequate for the ignition and operation of high-pressure sodium discharge lamps from a 60 Hz AC supply, but are unsuitable for the ignition and operation of HID lamps, especially miniature metal halide lamps, at high frequencies such as 10 KHz and above.

SUMMARY OF THE INVENTION

It is an object of the present invention to provide a simple, reliable, efficient and economical starting circuit for HID lamps, especially for miniature metal halide lamps, of the type which require high starting voltages and which are to be energized by a high frequency DC/AC inverter.

A further object of the invention is to provide a measure by which, while maintaining the power for obtaining a suitable voltage pulse, the arrangement is also suitable for use together with a high-frequency supply source.

For this purpose, according to the invention, the switching arrangement is characterized in that the common impedance also comprises an inductor.

Thus, the voltage-increasing property of the switching arrangement is maintained while the same voltage pulse can be obtained with a much smaller capacitor, the dimensioning of the switching arrangement being otherwise the same.

The use of an inductor in the common impedance makes it possible to dimension the latter so that the impedance has a high value for the frequency which is characteristic of the voltage pulses produced in the switching arrangement while the impedance has a comparatively low value for the frequency of the supply source which energizes the switching arrangement. The comparatively low value of the impedance for the supply source frequency has the favorable result that comparatively little dissipation occurs when charging the second capacitor and that the voltage pulse repetition frequency can be comparatively high. Thus, it is also possible to use the switching arrangement for a lamp operated on a supply source with a high frequency, for example, between 1 and 100 kHz.

The semiconductor switch will preferably be a breakdown element because this results in a further simplification of the switching arrangement.

The coil may form a part of a stabilization ballast of the lamp to be operated. However, it is also possible that the coil be entirely separate from the stabilization device, for example, in case the stabilization is provided by an electronic ballast unit or a switch mode power supply. The switching arrangement may be either separate from the lamp to be operated or be incorporated into the relevant lamp.

Another object of the invention is to provide a starting circuit for HID lamps which is slaved to the instantaneous ignition requirements of the lamp and which automatically ceases operation once the lamp has started.

A further object of the invention is to provide an efficient starting circuit for a miniature metal halide lamp energized by a high frequency AC source where the lamp starting voltage is substantially higher than its operating voltage.

A still further object of the invention is to provide a new and improved circuit for starting and operating a HID lamp which utilizes a step-up transformer with a lower turns ratio than is customary in prior art circuits of this type.

As mentioned above, a new starting circuit is required for metal halide lamps because of the stringent requirements relating to the starting voltage, the reignition voltage and the lamp current waveform In order to provide a small and economical starter/ballast for metal halide lamps, it is proposed to energize same from a high frequency AC source. The high-frequency operation requires a new starting circuit that differs from the known starting and operating circuits for HID lamps energized by a 60 Hz AC source.

A simple and efficient starting and operating apparatus is provided for connection of a metal halide lamp to a source of high frequency energy, e.g. a DC/AC transistor inverter with an output frequency preferably in the range of 1 KHz to 100 KHz, via a series arranged step-up ballast/ignition inductor or transformer, e.g. an inductor having a tap that defines a step-up transformer. A voltage multiplier including capacitor means and diode means is coupled to the inductor or step-up transformer. The charge path for the capacitor means includes a further inductor. A two-terminal switching device periodically discharges the capacitor means via the transformer primary winding. The switching device is preferably a SIDAC element. The series inductor functions both as a ballast impedance and a step-up autotransformer for the generation of high voltage ignition pulses for the lamp. The use of the further inductor in the capacitor charge path, rather than a resistor, provides a low charging impedance for the capacitors while maintaining a high impedance to the high frequency ignition pulses. An inductor also produces much less power loss than a resistor A preferred embodiment of the invention uses a voltage doubler circuit including first and second capacitors having capacitance values C2 and C1, respectively, wherein $C1 >> C2$, and the first capacitor is in a common charge path so that it charges in both directions. As a result, the first capacitor controls the charge rate of the second capacitor and thus the repetition rate of the ignition pulses generated. The second capacitor controls the pulse energy delivered to the lamp. Thus, by separating these two functions, pulse energy and repetition rate, the circuit is able to deliver ignition pulses at, for example, a 2 KHz rate, while at the same time the circuit produces negligible loading of the high frequency inverter energy source.

The generation of high voltage ignition pulses for starting the lamp combines an autotransformer with a relatively low step-up turns ratio, preferably in the range of 6–10:1, and a voltage multiplier operative as a preconditioner for the voltage supplied to the autotransformer. This combination results in a DC/AC inverter with a relatively low open circuit voltage, which improves the overall system efficiency. The repetition rates of the starting pulses now can be relatively high, which makes possible rapid lamp ignition.

The very different nature of metal halide lamps versus high pressure sodium lamps and the high frequency operation thereof prevent the use of the known circuit arrangements under the present conditions. For example, a typical 35W metal halide lamp will have a normal operating voltage of 85V at 0.41A. The fast warm-up mode for this lamp requires currents as high as 2A and lamp ignition necessitates voltage pulses of a few KV at relatively high repetition rates.

The relatively low autotransformer step up ratio provides better winding coupling which allows pulse energy to be more effectively transferred to the lamp, thus providing the follow through energy required by some lamp types in order to achieve stable burning.

The leakage inductance of an autotransformer is proportional to $(1-\text{Tapped Turns/Total Turns})^2$. An increase of the Tapped Turns/Total Turns ratio will improve the winding coupling and will optimize the amplitude of the ignition pulses generated. An increased number of tapped turns (one full layer, if possible) will bring the tap winding width closer to the core window width, thereby reducing the flux dispersion to provide a further reduction of the leakage inductance, an important advantage for high frequency operation.

Another advantage is that the invention provides a high voltage circuit without high voltage components, especially high voltage diodes.

A further advantage is that the circuit can be used at low frequencies (e.g. 60 Hz) when an ignition pulse is not required each cycle. Circuit losses will be lower than where a resistor is used to control the capacitor charge current.

A further preferred embodiment of the invention makes it possible to reduce the number of components in the starting circuit. This is accomplished by magnetically coupling the further inductor in the capacitor charge path to the ballast inductor (autotransformer), e.g. by winding the autotransformer and the further inductor on the same magnetic core.

An advantage of the further embodiment is that the starting circuit provides the same performance with fewer components than in the original circuit.

BRIEF DESCRIPTION OF THE DRAWINGS

For a better understanding of the invention, together with its objects and advantages, reference may be had to the preferred embodiments exemplary of the invention shown in the accompanying drawings and described below, in which:

FIG. 2 is a circuit diagram of a second embodiment of the invention, and

FIG. 3 is a circuit diagram of a third embodiment of the invention.

DESCRIPTION OF THE PREFERRED EMBODIMENTS

Figure 1:
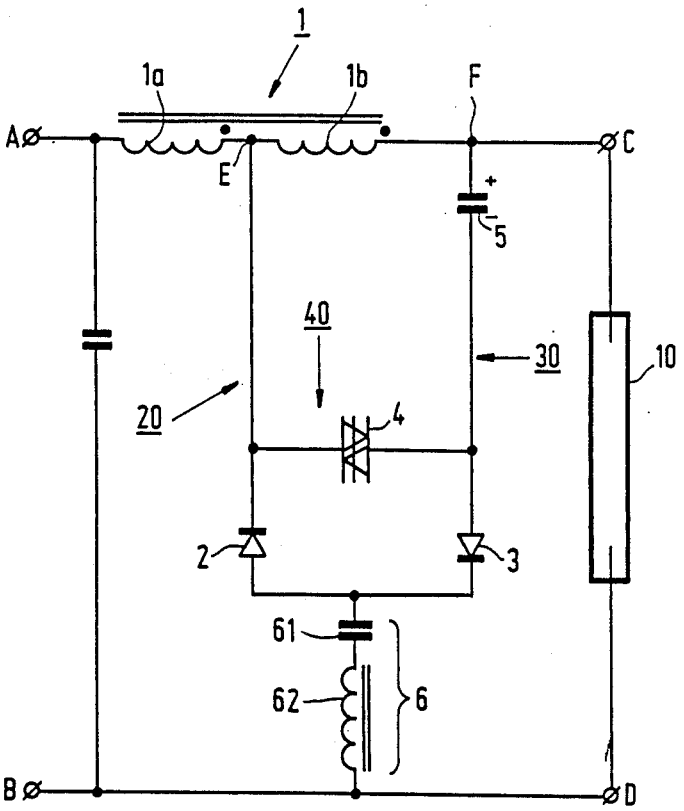
FIG. 1 is a circuit diagram of a first embodiment of the present invention.

FIG. 1 illustrates a first preferred embodiment of the invention. A pair of input terminals A, B are provided for connection of the starting and operating circuit to the output of a high frequency AC source, such as a DC/AC transistor inverter (not shown) operating at a frequency of approximately 10 KHz. Terminal A denotes a first supply source connection point and B denotes a second supply source connection point. Terminal C denotes a lamp connection point to which a high-pressure discharge lamp 10, for example, a miniature metal halide lamp, is connected. The lamp is connected through a further lamp connection point D to the second supply source connection point B. An inductor 1 with a tap point E is connected between the first supply source connection point A and the lamp connection point C. The inductor 1 serves both as a ballast impedance for the lamp during normal operation thereof and, by means of the tap point E, as an autotransformer for the generation of high voltage ignition pulses.

A voltage doubler circuit is connected to terminal F and the tap point E on the inductor. The inductor 1 thus has the form of a step-up autotransformer having a primary winding between circuit points E and F. The voltage doubler circuit includes a first branch 30 connected at the point F to the coil 1 and is provided with a diode 3 with a first capacitor 5. A second branch 20 is connected to the tap point E and includes a diode 2. The two diodes 2 and 3 are interconnected through a third branch 40 including a bilateral semiconductor switch 4, for example, a SIDAC. The first capacitor 5 is connected between on the one hand the coil and on the other hand the third branch 40 and the diode 3. The branches 20, 30 are connected through a common impedance 6 to the second supply source connection point B. The impedance 6 is constituted by a second capacitor 61 and an inductor 62. These circuit elements together form a voltage doubler circuit for increasing the amplitude of the ignition pulses generated by the starter circuit. The capacitance value $C_1$ of capacitor 5 is much greater than the capacitance value $C_2$ of the capacitor 61.

When the switching arrangement is connected to an alternating voltage supply source, the capacitors 5 and 61 are in a discharged state while the SIDAC 4 is in the off state. In the half cycle of the high frequency AC supply source when terminal B is positive with respect to terminal A, current flows through the inductor 62, capacitor 61, diode 2, winding la and back to the negative terminal A, thereby transferring charge to the capacitor 61. During this half cycle the diode 3 prevents the flow of current through the capacitor 5.

During the next half cycle, when input terminal A is positive with respect to terminal B, current flows through the full winding of the autotransformer 1, capacitor 5, diode 3, capacitor 61 and inductor 62 back to input terminal B. Since the capacitance, $C_2$, of the capacitor 61 is much smaller than the capacitance $C_1$, of capacitor 5, the charge rate of capacitor 5 is controlled primarily by the impedance of capacitor 61.

The capacitor 5 will be charged to a voltage exceeding the supply voltage. At most double the peak value of the supply voltage will be applied across the capacitor 5. As soon as the voltage across the semiconductor switch 4 reaches the breakdown voltage of this element, the semiconductor switch 4 will begin to conduct and the capacitor 5 will be discharged abruptly via the winding lb of the coil 1. By means of the coil 1, the voltage pulse produced will be transformed upwards due to the winding 1*a* and the coupling thereof to winding 1*b* so that a high voltage pulse appears at the lamp connection point C.

When the pulse amplitude decays sufficiently, the switch 4 will become non-conductive. If the lamp does not ignite on the first voltage pulse, the procedure described will be repeated. The value of the capacitor 61 then determines the rate at which the capacitor 5 is charged and hence the repetition frequency of the voltage pulses produced.

The circuit operates in a resonant manner with the resulting oscillations in the RF frequency range. The inductance $L_2$ of the inductor 62 is selected so that the $C_2-L_2$ combination of capacitor 61 and inductor 62 presents a high impedance to the high frequency oscillations and thus prevents undue loading of the ignition pulses. If the SIDAC has a breakdown voltage equal to twice the DC/AC inverter open circuit peak voltage, then the height of the generated ignition pulses is equal to the ratio of the Total Turns of the autotransformer 1 to the Tapped Turns (between terminals E and F) times the peak to peak open circuit voltage of the inverter.

Prior to lamp ignition capacitor 61 is alternately charged to the peak value of the AC source voltage at terminals A, B through diodes 2 and 3. When diode 3 is forward biased, the charge path is through capacitor 5. Capacitor 5 charges toward the peak to peak value of the source voltage with the polarity shown. Because capacitor 61 is typically smaller in value than capacitor 5, it takes several cycles of the source voltage for this to occur.

The SIDAC 4 is selected to have a breakdown voltage less than the peak to peak AC source voltage but greater than the peak to peak lamp operating voltage. When capacitor 5 is charged to the SIDAC breakdown voltage, it is discharged into the tap winding lb of the ballast choke 1. This voltage is increased by the turns ratio of L1. The capacitor between terminals A and B is a low impedance at the ignition pulse frequency and thus the pulse is applied across the lamp terminals. Inductor 62 reduces the pulse loading.

It will take a few cycles of the high frequency input waveform to charge the capacitor 5 to the breakdown voltage of the SIDAC 4. However, due to the high frequency nature of the input voltage at terminals A, B, the generation of the ignition pulse can occur at a fraction of the time required for a starter circuit that operates directly from a 60 Hz AC supply voltage.

The blocking voltage of the diodes 2 and 3 is determined by the voltage applied to the SIDAC and so the reverse blocking voltage of the rectifier diodes has only to be higher than the SIDAC breakdown voltage.

After the lamp 10 has ignited and is in normal operation, the inductor 1 provides the usual ballast function for the lamp and the voltage across the lamp terminals drops to the operating voltage of the lamp, which is chosen to be lower than the breakdown voltage of the SIDAC 4. The capacitor 5 now cannot charge to the breakdown voltage of SIDAC 4. As a result, the starting circuit effectively ceases operation and no longer generates ignition pulses for the lamp. The use of the inductor 62 instead of a resistor provides a low charging impedance for the capacitors while maintaining a high impedance to the high frequency ignition pulses. The repetition frequency of the ignition pulses is controlled by a proper selection of the $C_1/C_2$ ratio of capacitors 5 and 61. It is limited by the high frequency current ratings of presently available SIDACS.

The combination of an autotransformer having a relatively low turns ratio and a voltage doubler as a preconditioner for the voltage applied to the autotransformer makes it possible to use a DC/AC inverter having a relatively low open circuit voltage. This improves the system's overall efficiency. Furthermore, the resulting high repetition rate of the starting pulses provides fast ignition of the lamp.

This circuit has the advantage that the charge rate of capacitor 5, which is chosen to deliver the proper pulse energy, is controlled primarily by the reactive impedance of capacitor 61, and not by a resistive element which could contribute considerable losses at high pulse repetition rates. In addition, capacitor 61 forms part of the voltage doubler action which causes capacitor 5 to charge toward twice the source voltage peak. In this way higher peak voltages can be generated or a lower autotransformer ratio is required for the same peak ignition voltage.

An inductor turns ratio in the range of 6–8:1 provides optimum ignition and warm-up of a metal halide lamp energized from a high frequency DC/AC inverter. This turns ratio also improves the winding coupling of the autotransformer thereby optimizing the amplitude of the ignition pulses generated. It also provides a reduction in the transformer leakage inductance.

In a practical example, the supply source consisted of an up converter followed by a sine converter supplying an output voltage of 300 V, 10 kHz. The connected lamp was a metal halide lamp having a nominal power of 35 W at a nominal current of 0.42 A and a nominal arc voltage of 85 V. The coil 1 had a value of 6 mH, the part 1*a* comprising 153 turns and the part 1*b* comprising 26 turns. The coil 1 acted at the same time as a stabilization ballast. The first capacitor 5 had a value of 15 nF and the second capacitor 61 had a value of 2.7 nF. The repetition frequency of the voltage pulse produced was 2 kHz. The inductor 62 had a value of 20 mH and acted as a high-frequency filter.

The impedance of the inductor 62 during charging of the second capacitor 61 was therefore 1.2 kΩ. The voltage pulses produced in the switching arrangement had a frequency characteristic of approximately 150 kHz. For this frequency of 150 kHz, the impedance of the inductor 62 was 19 kΩ. Since the impedance of the inductor 62 at the characteristic frequency of the voltage pulses produced was considerably higher than in the case of the prior art, the inductor 62 constitutes a considerably better barrier which prevents the voltage pulse produced from flowing away directly to the supply source.

With the use of a supply source frequency of 50 Hz, inductor 62 represents an impedance of 6Ω. Therefore, the suitability of the switching arrangement for use with a supply source having a frequency of 50 Hz is not only maintained, but is even improved as compared with the prior art.

The diodes 2 and 3 were of the type BYV 95 C, TM Philips. The semiconductor switch 4 was in the form of two series-connected SIDACS of the type K 2400 F 23, trademark Teccor. The voltage pulse formed at the lamp connection point C was in the practical example described 2.9 kV.

In order to attenuate oscillations of the voltage pulse in the circuit constituted by the coil part 1*b*, the first capacitor 5 and the semiconductor switch 4, a resistor of about 10Ω (not shown) may be used, preferably in series with the SIDAC in the third branch in order not to influence the charging of the first capacitor 5. Such a resistor will also limit SIDAC dissipation to a safe value. If the cathode of diode 2 is connected instead to point F, an ignition pulse without ringing will result because of the damping action of diodes 2 and 3 across capacitor 5. Alternatively, the positions of capacitor 5 and SIDAC 4 may be interchanged in the circuit to achieve the same damping action. These are additional methods of keeping SIDAC dissipation within safe limits.

FIG. 2 shows a second embodiment of a starting and operating circuit for a metal halide lamp energized via terminals A, B by a high frequency DC/AC inverter, not shown. This circuit produces higher ignition voltage pulses than the circuit of FIG. 1, while still retaining the advantageous properties thereof. The starting circuit of FIG. 2 can generate ignition pulses equal to four times the ratio of the total winding turns to the tapped winding turns times the inverter open circuit peak voltage at input terminals A, B. In this circuit, components corresponding to those in FIG. 1 are designated by like reference numerals. This circuit consists of two voltage doublers each similar to that of FIG. 1 and connected in a back-to-back configuration.

The first voltage doubler circuit includes the elements 8, 11, 13 and 14 connected between the tap point E on the autotransformer 1 and the input terminal B. The second voltage doubler circuit includes a capacitor 16 of capacitance $C_3$ connected in series circuit with a diode 17 and a further capacitor 18 of capacitance $C_4$ and the inductor 62 between the terminal F of the autotransformer and the input terminal B. A series circuit of a diode 19 and a small current limiting resistor 23 is connected in parallel with the series combination of capacitor 16 and diode 17. The diode 19 is connected with opposite polarity to the diode 17. The SIDAC 4 and the current limiting resistor 9 are connected between the junction of capacitor 14 and diode 8 and the junction of capacitor 16 and diode 17.

Each of the voltage doubler circuits operates in a manner similar to that described for the voltage doubler in FIG. 1. Therefore, the principle of operation of the circuit of FIG. 2 is basically the same as that of the circuit of FIG. 1. Preferably, the two voltage doublers are identical, i.e. $C_1=C_3$, $C_2=C_4$ and $R_1=R_3$ where $R_1$ and $R_3$ are the resistance values of the current limiting resistors 21 and 23, respectively. Resistors 9, 23 and 21 are optional in that they are used to limit the current through their respective series connected semiconductor elements. Capacitor 7 also is optional since it is only present to prevent DC current flow in the lamp.

The basic difference in the operation of the circuit of FIG. 2 in comparison to that of the circuit of FIG. 1 is that in the FIG. 2 circuit, it is the sum of the capacitor voltages, 16 and 14, which causes the SIDAC 4 to break down and which determines the height of the starting pulses. The breakdown of the SIDAC 4 in FIG. 2 can be set to a value which is twice that of the corresponding SIDAC in the circuit of FIG. 1, thereby providing a starting circuit that produces substantially higher voltage ignition pulses with the same winding turns ratio of the inductor 1. The pulse voltage applied to the tap on the ballast inductor can approach 4 times the peak value of the AC source voltage. Note that in this configuration oscillations will be damped by the diodes.

The frequency of oscillations in the ignition mode is defined by the combination of the inductance of the tapped portion of the winding 1 and the capacitance value $C_1/2$, where $C_1$ is the capacitance of capacitor 14, which is preferably equal to the capacitance (C3) of the capacitor 16. The charging impedance for the capacitors 14 and 16 is determined by the combination of the inductances L1 and L2 of inductors 1 and 62, respectively, and 2 $C_2$ to a first approximation, where $C_2$ is the capacitance of capacitor 11. If the SIDAC breakdown voltage is lowered, the starting pulse repetition rate will be higher compared to that of the FIG. 1 circuit.

FIG. 3 shows a modification of the starting circuit of FIG. 1 which makes it possible to reduce the number of circuit components. The circuit components in FIG. 3 that are identical to those in FIG. 1 have like reference numerals.

An analysis of the voltages and currents in the starting circuit of FIG. 1 has revealed that the inductor 62 therein can be magnetically coupled to the ballast inductor 1. FIG. 3 symbolically shows that the windings $N_1$ and $N_2$ of the inductor are magnetically coupled to the winding 32 of the charging inductor. The polarity of the windings is shown by the conventional dot symbols. The only other difference with respect to the circuit of FIG. 1 is that the position of the SIDAC 4 and the current limiting resistor 9 have been interchanged with the capacitor 5. The principle of operation of the starting circuit of FIG. 3, however, is the same as that of the circuit of FIG. 1. The starting pulse voltage capabilities are also the same for the two circuits.

The charging impedance for the capacitors 61 and 5 is now determined by the combination of the capacitance $C_2$ of the capacitor 61 and the effective inductance that results from the combination of the windings $N_1$ and $N_3$, which have opposite polarities. In order to provide automatic cut-off of the starting circuit once the lamp has started, the $N_1/N_3$ turns ratio should be properly selected. Ideally, this ratio would be equal to one. However, this would produce a voltage across the capacitor 5 which would be high enough to cause the breakdown of the SIDAC 4 after the lamp has started. For this reason, the voltage of the winding $N_3$ should be chosen to be different from the voltage of the winding $N_1$ by a value high enough to reduce the voltage across capacitor 5 to a value below the SIDAC breakdown voltage so that the starting circuit can be automatically cut-off once the lamp has ignited. In view of the choice of the polarity of the windings $N_1$ and $N_3$, the insulation of the ballast inductor 31 should be chosen so as to withstand a potential difference equal to approximately $(1+N_3/N_1)$ times the starting pulse voltage.

Although several embodiments of the invention have been shown and described in detail, it will be understood that this description and the illustrations are offered merely by way of example, and that the invention is to be limited in scope only by the appended claims.

What is claimed is:

1. An apparatus for starting and operating a high intensity discharge lamp comprising:

a pair of input terminals for supplying a high frequency voltage to the apparatus, a pair of output terminals for connection to a high intensity discharge lamp, means including a step-up transformer for coupling said input terminals to said output terminals, and a voltage multiplier circuit coupled to a primary winding of said step-up transformer, said voltage multiplier circuit comprising:

a relatively resistance free impedance means, a first capacitor and a first rectifier element connected in a first series circuit with said impedance means to said primary winding, a second capacitor and a second rectifier element connected in a second series circuit with said impedance means to said primary winding, and a voltage responsive switching device connected in a further closed loop series circuit with the second capacitor and said primary winding, whereby when said second capacitor is charged to the breakdown voltage of the switching device the switching device turns on to provide a rapid discharge path for the second capacitor via said primary winding thereby to induce a high voltage pulse in a secondary winding of the transformer for igniting a discharge lamp connected to said output terminals.

2. An apparatus as claimed in claim 1 wherein said switching device comprises a two-terminal semiconductor device through which substantially all discharge current of said second capacitor flows.

3. An apparatus as claimed in claim 1 wherein, said step-up transformer comprises an autotransformer connected between a first one of said input terminals and one of said output terminals, said first series circuit is connected between a tap point on the winding of said autotransformer and a second one of said input terminals, and said second series circuit is connected between an end terminal on said winding closest to said one output terminal and said second one of the input terminals.

4. An apparatus as claimed in claim 3 wherein said first and second rectifier elements are oppositely polarized as viewed from a common terminal of said impedance means.

5. An apparatus as claimed in claim 1 wherein said impedance means comprises an inductor and said step-up transformer has a step-up turns ratio which is at most 8 to 1.

6. An apparatus as claimed in claim 1 wherein said second and first capacitors have capacitance values of $C_1$ and $C_2$, respectively, and wherein $C_1 >> C_2$.

7. An apparatus as claimed in claim 1 wherein, said step-up transformer comprises an autotransformer connected between a first one of said input terminals and one of said output terminals and having a tap point connected to said voltage multiplier circuit, said autotransformer having a winding with an inductance value sufficient to provide a current limiting ballast function for a connected discharge lamp in the normal operating condition of the lamp.

8. An apparatus as claimed in claim 1 wherein said switching device comprises a two-terminal semiconductor device having a breakdown voltage that is higher than the operating voltage of a connected discharge lamp thereby to inhibit generation of voltage ignition pulses when a discharge lamp is in normal operation.

9. An apparatus as claimed on claim 1 wherein said impedance means comprises an inductor having a winding magnetically coupled to a winding of said step-up transformer.

10. An apparatus as claimed in claim 9 wherein said step-up transformer comprises an autotransformer connected between a first one of said input terminals and one of said output terminals and having a tap point that divides a winding thereof into first and second winding sections between the tap point and said first input terminal and said first output terminal, respectively, said first winding section and said inductor winding being wound on a common magnetic core with opposite polarities.

11. An apparatus as claimed in claim 9 wherein said switching device comprises a two-terminal semiconductor device and said first and second rectifier elements are oppositely polarized as viewed from a common terminal of said inductor.

12. An apparatus as claimed in claim 1 wherein said primary winding and said second capacitor together provide a resonant discharge circuit for the second capacitor in the RF frequency range.

13. An apparatus as claimed in claim 1 wherein said input terminals are adapted to be connected to a high frequency transistor inverter and said output terminals are adapted to be connected to a metal halide discharge lamp.

14. An apparatus as claimed in claim 1 wherein said first capacitor is part of a common charge path for the second capacitor and provides primary control of the charge rate of the second capacitor.

15. An apparatus for starting and operating a high intensity discharge lamp comprising:

a pair of input terminals for supplying a high frequency voltage to the apparatus, a pair of output terminals for connection to a high intensity discharge lamp, means including a step-up transformer for coupling said input terminals to said output terminals, and a voltage multiplier circuit coupled to a primary winding of said step-up transformer, said voltage multiplier circuit comprising:

a relatively resistance-free impedance means, a first voltage doubler circuit coupled in series with said impedance means between a first terminal of said primary winding and one of said input terminals, a second voltage doubler circuit coupled in series with said impedance means between a second terminal of said primary winding and said one input terminal, said first voltage doubler circuit including a first capacitor coupled to said first terminal of the primary winding, said second voltage doubler circuit including a second capacitor coupled to said second terminal of said primary winding, and a voltage responsive switching device coupling said first and second capacitors and said primary winding in a closed loop circuit whereby when said first and second capacitors are charged to the breakdown voltage of the switching device the switching device turns on to provide a rapid discharge path for the first and second capacitors via said primary winding thereby to induce a high voltage pulse in a secondary winding of the transformer for igniting a discharge lamp connected to said output terminals.

16. An apparatus as claimed in claim 15 wherein said first voltage doubler circuit further comprises:

a first rectifier element and a third capacitor connected in a first series circuit with said first capacitor and said impedance means between said first terminal of the primary winding and said one input terminal, and a second rectifier element connected in parallel with a series combination of the first capacitor and the first rectifier element, and wherein the second voltage doubler circuit comprises:

a third rectifier element and a fourth capacitor connected in a second series circuit with said second capacitor and said impedance means between said second terminal of the primary winding and said one input terminal, and a fourth rectifier element connected in parallel with a series combination of the second capacitor and the third rectifier element.

17. An apparatus as claimed in claim 16 wherein said first and second rectifier elements are oppositely polarized as viewed from a common terminal of said impedance means and likewise for said third and fourth rectifier elements.

18. An apparatus as claimed in claim 17 wherein said first and third rectifier elements and said second and fourth rectifier elements, respectively, are oppositely polarized as viewed from said common terminal of said impedance means.

19. A switching arrangement for starting a high-pressure discharge lamp comprising a first supply source connection point for connection to a supply source and a first lamp connection point for connection to the high-pressure discharge lamp, an electrical inductor connected between said first supply source connection point and said first lamp connection point, the switching arrangement further comprising a first and a second branch each including a diode and each connected to the inductor, one branch of which is connected to a tap point on the inductor, the two diodes being interconnected by a third branch including a semiconductor switch in a manner such that the third branch is connected at one end directly both to the inductor and the diode of the second branch, wherein the first branch includes a first capacitor connected between the inductor and the third branch and the relevant diode, means connecting the first and the second branch via a common impedance to a second supply source connection pint, said common impedance including a further inductor and a second capacitor, and means coupling a second lamp connection point to said second supply source connection point.

* * * * *